United States Patent [19]

Lemelson

[11] 4,166,489

[45] Sep. 4, 1979

[54] KEY AND COIN HOLDER

[76] Inventor: Jerome H. Lemelson, 85 Rector St., Metuchen, N.J. 08840

[21] Appl. No.: 879,393

[22] Filed: Feb. 21, 1978

[51] Int. Cl.[2] ..... A45C 1/00

[52] U.S. Cl. ..... 150/35; 70/456 R; 150/34; 150/37

[58] Field of Search ..... 150/35, 34, 37, 40; 70/456 R, 457, 458; 206/38, 81

[56] References Cited

U.S. PATENT DOCUMENTS

| | | | |
|---|---|---|---|
| 2,777,492 | 1/1957 | Kikuchi | 150/37 |
| 2,868,254 | 1/1959 | Saad | 150/37 X |
| 3,111,152 | 11/1963 | Goessling | 150/35 |
| 3,160,186 | 12/1964 | Conley | 150/37 |
| 3,299,930 | 1/1967 | Schumer | 150/40 |
| 3,318,354 | 5/1967 | Borisof | 150/37 X |
| 3,620,057 | 11/1969 | Holland | 70/456 R |
| 3,918,503 | 11/1975 | Bundy | 150/37 X |

*Primary Examiner*—Donald F. Norton

[57] ABSTRACT

A combined key holding device which also includes a container portion for holding one or more coins or other objects. In a preferred form, the container and key holder are molded of a unitary plastic molding which includes a retaining portion for a key ring and a container portion for one or more coins or other objects. The ring holding portion is molded as a strip which is attached to itself or an extension of the container portion so as to form a loop for holding the ring. The container portion is formed with a lid or cover forming part of the unitary plastic molding with a hinge portion joining it to the container portion. In a particular form, the ring holding loop portion is attached to itself by mushrooming a portion thereof and/or by heat sealing or welding. The container lip portion snap assembles to the rim of the container without the need for a fastener.

5 Claims, 4 Drawing Figures

KEY AND COIN HOLDER

SUMMARY OF THE INVENTION

This invention relates to a novel construction in a container for coins which also may be utilized to hold one or more keys, preferably secured to a ring. The entire container and retainer for the ring is injection molded for a unitary molding containing one or more hinge portions and one or more portions for retaining the ring in assembly with the container. The device is both low in cost to produce and simple in structure.

Accordingly, it is a primary object of this invention to provide a new and improved structure in a container and a retainer for one or more keys.

Another object is to provide a unitary molding defining a container and ring retainer.

Another object is to provide a combined retainer for keys and coins which may be easy to produce and low in cost.

Another object is to provide a combined key holder and coin container which has very few parts.

Figure 1:
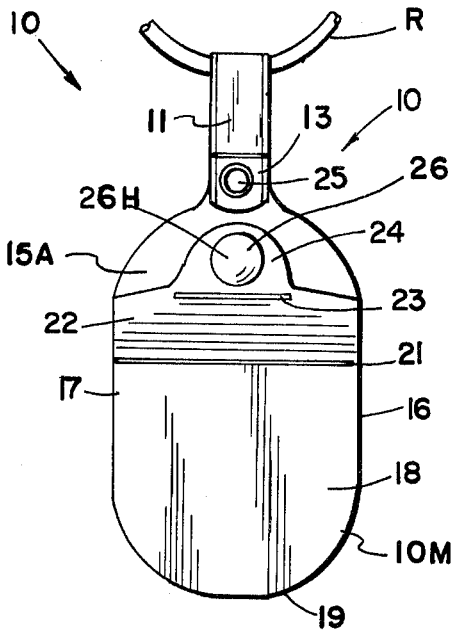
FIG. 1 is a front view of a combined key holder and coin containing unit made of a single injection molding and employing a snap fastener for retaining the coin holding unit closed.
Figure 2:
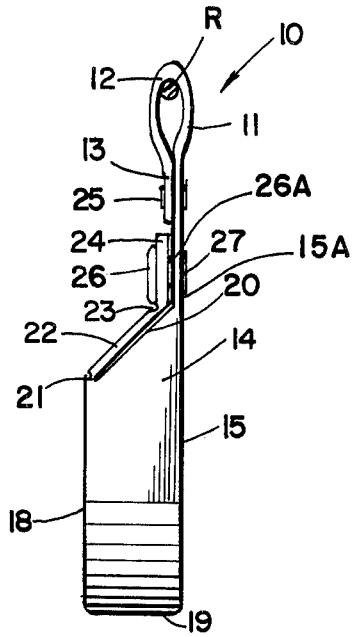
FIG. 2 is a side view of FIG. 1.

In FIGS. 1 and 2 is shown a first form of the invention comprising an assembly 10 of unitary molding 10M of plastic resin formed with a relatively thin strap portion 11 which is formed in a loop 12 and has its free end 13 secured to its other end by means of a rivet 25. Strap portion 11 is connected to the main body 14 of the molding which is shaped to define a container for coins or other small objects. A ring or other holder R for one or more keys may be held by and passed through the loop 12.

The container portion 14 is formed in the configuration of a box formation having rear and front walls 15 and 18, side walls 16 and 17 and a bottom wall 19 which is shown as arcuate in shape although it may be flat.

Extending as a portion of the molding from the front wall 15 and connected thereto by a molded hinge portion 21 is a flap or cover 22 which provides a closure for the container 14 when abutting the upper edging 20 of the side walls 17 and 18 and defines a manually operable means for the release of coins from container portion 14 when opened by hand. A snap fastener 26 composed of a female component 26A and a male fastener component 27 is secured to the flap 22 with the male part 27 secured to the rear wall 15. The fastener 26 is employed to secure the flap in a container closing condition.

The outer portion or head 26H of the female part 26A of the snap fastener may be shaped to permit it to easily grasped between the fingers to open the fastener by pulling. The end portion 24 of the flap or cover 22 may be shaped to facilitate opening by being curled outwardly, as shown.

A second molded-in hinge portion 23 divides the end portion 24 from the main flap or cover and permits said end portion to be flush against the face of the upper extension 15A of the rear wall 15.

The entire container 10, with the exception of the rivet or grommet 25 may be injection molded in one piece of a suitable plastic resin such as polypropylene, medium or high density polyethylene, ethylene vinyl acetate or other resin having sufficient rigidity and capable of being injection molded with integral hinge portions, as described, to provide the flap-like closure or lid 22 and the tab portion 24 for pivotally opening same.

Figure 3:
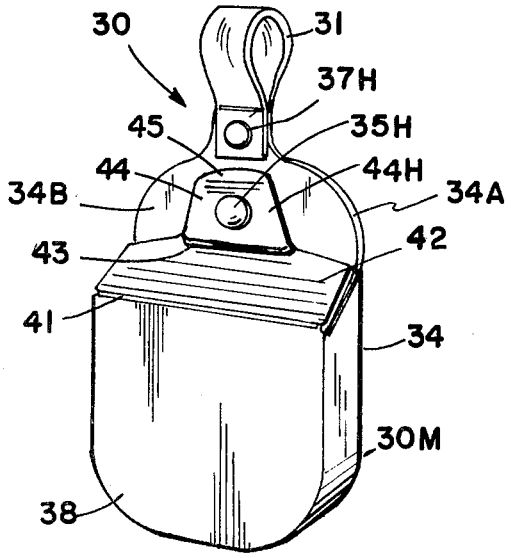
FIG. 3 is an isometric view of a modified form of the device of FIGS. 1 and 2 wherein the snap fastener is eliminated.
Figure 4:
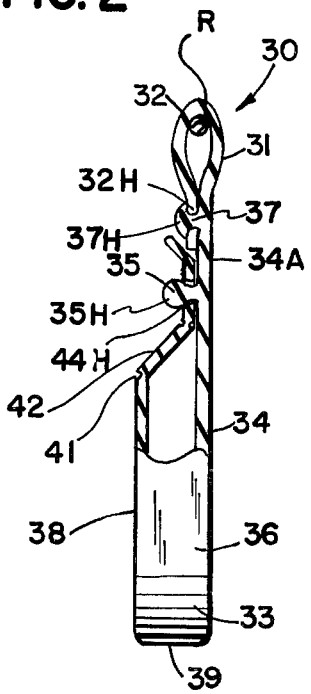
FIG. 4 is a side view of FIG. 3 partially sectioned.

FIGS. 3 and 4 illustrate a modified form of key retaining device and coin containing means similar in configuration to the device 10 of FIGS. 1 and 2 with the exception that the molding 30M is so shaped as to eliminate the need for separate fasteners such the described rivets or grommets. The device 30 is a unitary molding 30M of one of the plastic resins described, having a lower portion 33 in the shape of a container and formed with a front wall 38, rear wall 34, side wall 36 and a bottom wall 39. The upper portion 34A of the rear wall 34 extends to a strap portion 31 which is formed in a loop-like formation 32 and has a hole 32H molded therethrough. A cylindrical protrusion or tit 37 is molded integral with the base of the strap portion 31 and passes through the hole 32H in the other end of the strap portion 31 after which the end of the protrusion 37 is musroomed by applying a heated tool thereto forming a head 37H thereof holding the strap portion 31 in the loop-like configuration around a metal or plastic ring as shown in FIG. 1.

The front wall 38 of the container portion 33 extends to a flap 42 and is joined thereto by means of a molded hinge 41. A tab portion 44 is molded integral with the upper edge of flap 42 and has a hole 44H molded therethrough. A protrusion 35 having an enlarged bulbous head portion 35H is molded integral with the upper portion 34A of the rear wall 34 and is located extending forward thereof to permit it to be inserted in the hole 44H with the material of the tab portion 44 extending over and around the bulbous head 35H to frictionally retain the tab portion 44 flat against the front face 34B of the upper portion 34A of the rear wall 34 wherein the lateral edge portions of the flap 42 abut the upper edges of the side walls 36 of the container portion 33 and the flap 42 thereby forms a closure for the container defined by portion 33 of the unitary molding. Notation 45 refers to the upper end of the tab 44 which end is outwardly curled in shape as shown in FIG. 4 to facilitate pulling the tab away from the front face 34B of the rear wall 34 when it is desired to pivotally open the flap 42 to gain access to the interior of the container for removing or inserting coins.

In place of the riveted construction defined by the mushroomed protrusion 37, the end of the strip portion 31 may be heat sealed or welded to the base thereof using a heated tool after the ring R has been disposed within the loop formation thereof.

A latitude of modification in the shape of the container portion and the portions which protrude therefrom is intended. For example, the lid portions 22 and 42 of the configurations of FIGS. 1 and 3 may be molded with downwardly protruding edge walls or tabs adapted to frictionally grip respective portions of the lateral upper edges of the container side walls whereby the tab formations 24 and 44 may be eliminated. If a specially shaped cam action injection mold is employed, the loop formations 12 and 32 of the strip-like formations 11 and 21 may be molded to shapewherein the key ring R would necessarily be hinged or split to permit its assembly with such molded loop formation.

I claim:

1. A key holding device and container for coins and the like comprising:

a unitary plastic molding formed with a container portion for containing coins and the like and defining coin retaining means having front and rear wall portions and manually operable means for permitting the release of coins therefrom, said rear wall portion of said container having a flat portion molded integral therewith which flat portion extends outwardly beyond the container portion of said molding, a thin, flexible strip-like portion integrally molded to said outwardly extending flat portion of said rear wall portion of said container portion and formed in a loop with the end portion of said strip-like portion secured to said flat portion extending outwardly beyond the container portion of said molding so as to close and retain the loop closed, a ring held within said loop and containing one or more keys thereon, said container portion having a closure formed of the unitary molding, a hinge portion molded between said closure and said container portion for movably retaining the closure assembled with the container portion, and means for frictionally retaining said closure in a closed position against said container portion to retain objects held within the container portion.

2. A device in accordance with claim 1 wherein said means securing the end of said flexible strip-like portion of said molding comprises a rivet.

3. A device in accordance with claim 1 wherein said means retaining said flexible strip-like portion against said molding comprises a weld between said strip-like portion and a second portion of said molding.

4. A device in accordance with claim 1 wherein said frictional means retaining said lid in assembly with said container portion comprises a snap-fastener.

5. A device in accordance with claim 1 wherein said frictional means retaining said lid in assembly with said container portion comprises molded portions of said lid and said container portion.

* * * * *